US007047783B2

(12) United States Patent
Klein et al.

(10) Patent No.: US 7,047,783 B2
(45) Date of Patent: May 23, 2006

(54) AUXILIARY ADJUSTING DEVICE FOR ROLLING MILL STAND

(75) Inventors: Bernhard Klein, Hilchenbach (DE); Wolfgang Denker, Freudenberg (DE)

(73) Assignee: SMS DEMAG, Dusseldorf (DE)

( * ) Notice: Subject to any disclaimer, the term of this patent is extended or adjusted under 35 U.S.C. 154(b) by 18 days.

(21) Appl. No.: 10/847,124

(22) Filed: May 17, 2004

(65) Prior Publication Data

US 2004/0226335 A1 Nov. 18, 2004

(30) Foreign Application Priority Data

May 16, 2003 (DE) ..... 103 22 664

(51) Int. Cl.
*B21B 31/24* (2006.01)

(52) U.S. Cl. ..... 72/248; 74/89.42; 74/74; 74/409; 475/5

(58) Field of Classification Search ..... 72/243; 475/2, 5, 7; 74/89.42, 409
See application file for complete search history.

(56) References Cited

U.S. PATENT DOCUMENTS 3,486,393 A * 12/1969 Maxwell ..... 74/89.42
4,470,284 A * 9/1984 Noe et al. ..... 72/248
4,819,507 A 4/1989 Pescher
5,029,400 A * 7/1991 Leclercq et al. ..... 33/657

FOREIGN PATENT DOCUMENTS

DE 1427867 3/1969
DE 3319407 12/1982

* cited by examiner

*Primary Examiner*—Dmitry Suhol
(74) *Attorney, Agent, or Firm*—Abelman, Frayne & Schwab

(57) ABSTRACT

An auxiliary adjusting device for a rolling mill stand includes a adjusting shaft, a cylindrical member forming an adjusting spindle and having a first outer thread cooperating with the inner thread of a support sleeve fixedly connected to the cross-beam, and a central recess provided with longitudinal teeth, a carrier secured to a bottom of the cross-beam, projecting into the central recess of the cylindrical member, and carrying, at its end side, a tooth gear that functions as a planet gear that cooperates, on one hand, with a tooth gear secured at an end of the adjusting shaft which extends through the carrier, and serving as a sun gear, and, on another hand, with the longitudinal teeth of the central recess of the cylindrical member, and an adjusting pressure sleeve connected with the support sleeve for longitudinal displacement relative thereto but without a possibility of rotation relative thereto.

2 Claims, 1 Drawing Sheet

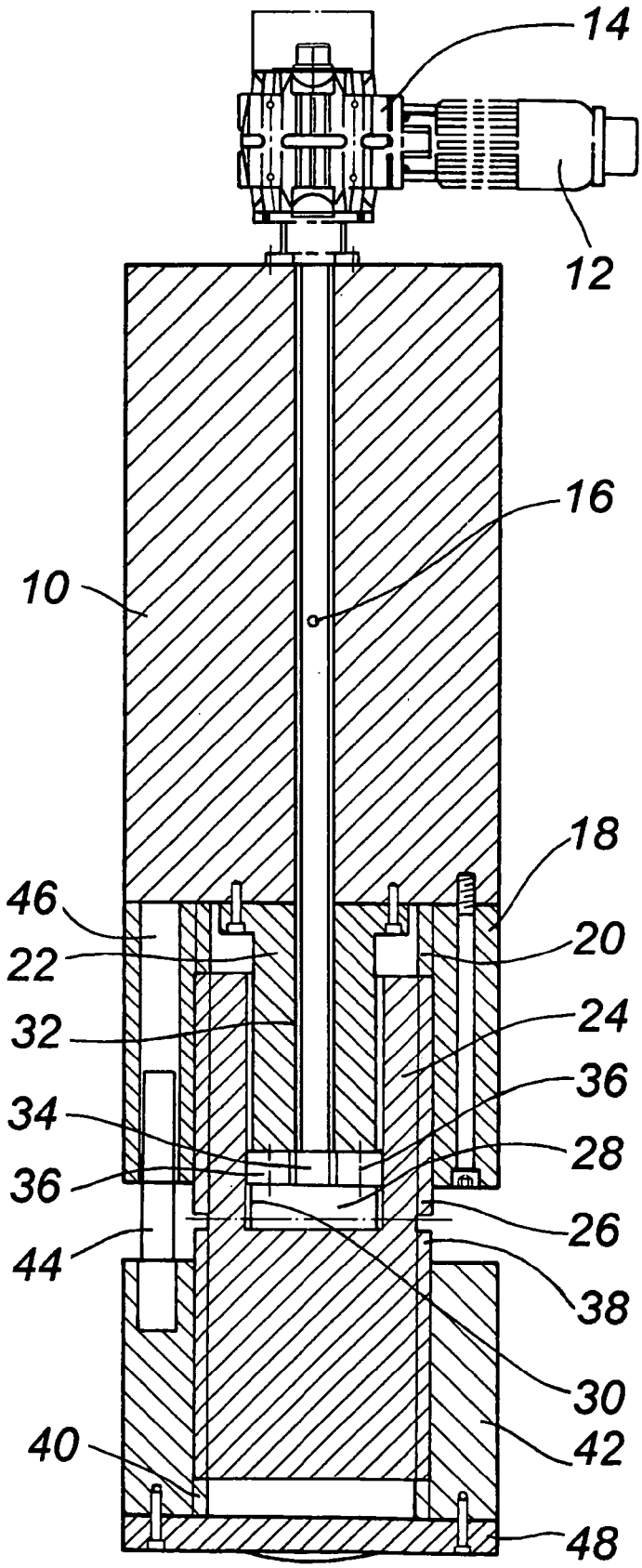
14
12
16
10
18
46
20
22
24
32
36
34
28
36
26
44
38
30
40
42
48

AUXILIARY ADJUSTING DEVICE FOR ROLLING MILL STAND

BACKGROUND OF THE INVENTION

1. Field of the Invention

The present invention relates to an adjusting device for a rolling mill stand with which adjustable values of two roll housings of a role mill stand are corrected in one or both housing.

2. Description of the Prior Art

In addition to conventional means for an adjusting correction of roll housings, such as stepped wedges, additional spindles, shim plates, all of which require an increased expenditure of labor and experimentations, there were proposals to provide in addition to adjusting gears for adjusting spindles of individual rolling mill stands, superimposed gears formed as planetary gears (DE 31 19 407A1 and U.S. Pat. No. 4,819,507) and associated with the primary adjusting gears. However, the provision of the auxiliary gears or devices is associated with increased expenses associated with provision of the auxiliary gears and the redesign of the stands themselves. The provision of the auxiliary gears is also associated with high maintenance costs.

A different adjusting device is disclosed in German Publication DE-AS 1 427 867 which includes an adjusting motor supported on or in the stand cross-beam, a planetary gear arranged beneath the cross-beam and the sun gear of which is connected with the drive shaft of the adjusting motor, and the planet gear carrier of which is connected with the adjusting spindle, which is screwed into the cross-beam, for joint rotation therewith. The planetary gear and the motor are arranged in a support frame which is vertically displaceable and is received in an upwardly open housing without a possibility of rotation relative thereto. The housing is arranged in the cross-beam, is secured therein, and has a through-bore for the adjusting spindle.

An object of the present invention is to provide an auxiliary adjusting device with a planetary gear but which would not require constructional changes in the rolling mill stand and would consist of a smaller number of components.

SUMMARY OF THE INVENTION

This and other objects of the present invention, which will become apparent hereinafter, are achieved by providing an auxiliary adjusting device including an adjusting shaft, an adjusting motor for driving the adjusting shaft and supported on the cross-beam of the rolling mill stand, a carrier sleeve fixedly connected to the cross-beam and having an inner thread, and a cylindrical member forming an adjusting spindle and having a first outer thread cooperating with the inner thread of the support sleeve, and a central recess provided with longitudinal teeth. A carrier is secured to a bottom of the cross-beam, and projects into the central recess of the adjusting spindle-forming, cylindrical member, and carries, at its end side, a tooth gear that functions as a planet gear that cooperates, on one hand, with a tooth gear secured at an end of the adjusting shaft which extends through the carrier, and serve as a sun gear, and, on another hand, with the longitudinal teeth of the central recess of the cylindrical member. The planet and sun gear form a planetary gear transmission. An adjusting pressure sleeve is connected with the support sleeve for longitudinal displacement relative thereto but without a possibility of rotation relative thereto. The adjusting spindle-forming, cylindrical member has, in its lower portion, a second outer thread running in a direction opposite to that of the first thread, and the adjusting pressure sleeve has an inner thread corresponding to the second outer thread of the cylindrical member and with which the adjusting pressure sleeve is screwed onto the lower portion of the cylindrical member, so that an adjustment linear displacement of the adjusting spindle-forming, cylinder member is transmitted to the adjusting pressure sleeve.

The adjusting motor can be relatively small and have a small weight. With the adjusting device according to the present invention, the adjustment can be effected with high rotational speeds and low torques, with the planetary gear being position-controlled. The roll separating force is transmitted by the adjusting spindle-forming cylindrical member which is connected, on one hand, with the cross-beam, via the support sleeve, and on the other hand, with the adjusting pressure sleeve, via the second outer thread. It is contemplated to arrange and axial bearing in the adjusting pressure sleeve because it does not rotate relative to the bearing bush of the roll which the adjusting pressure sleeve impacts.

The device can be arranged in the stand window of the stand or in a recess above or below the stand cross-beam. All of the components of the device can be easily manufactured.

The novel features of the present invention, which are considered as characteristic for the invention, are set forth in the appended claims. The invention itself, however, both as to its construction and its mode of operation, together with additional advantages and objects thereof, will be best understood from the following detailed description of a preferred embodiment, when read with reference to the accompanying drawings.

BRIEF DESCRIPTION OF THE DRAWINGS

In the Drawings.

Single FIGURE shows a cross-sectional view of an auxiliary adjusting device for a rolling mill stand according to the present invention.

DETAILED DESCRIPTION OF THE PREFERRED EMBODIMENT

An auxiliary adjusting device, which is shown in the drawing, includes an adjusting motor 12 and an angle gear 14 fixedly mounted on a cross-beam 10. The angular gear 14 is connected with an adjusting shaft 16 which is connected with the rolling mill stand and extends through the cross-beam 10. At the bottom of the cross-beam 10, there is provided a cylindrical support sleeve 18 provided with an inner thread 20. A cylindrical carrier 22 is arranged in the middle of the support sleeve 18 and is screwed to the cross-beam 10. A cylindrical member 24, which serves as an adjusting spindle, is provided with an outer thread 26 that cooperates with an inner thread 20, whereby the cylindrical member 24 is screwed into the support sleeve 18. The cylindrical member 24 is provided with an upward opening, central recess 28 on the inner surface of which, there are provided longitudinal teeth 30. The cylindrical carrier 22 projects into the recess 28. The carrier 22 has a central bore 32 through which the adjusting shaft 16 extends. At the end of the adjusting shaft 16, there is provided a tooth gear 34 that cooperates with a tooth gear 36 provided at the end side of the support 22. The tooth gear 34 forms a sun gear, and the tooth gear 36 forms a planet gear, so that together they form a planetary gear. The planet gear cooperates with the longitudinal teeth 30 of the cylindrical recess 28.

The cylindrical member 24, which forms the adjusting spindle, has, below its outer thread 26, a further oppositely running, outer thread 38. The oppositely running, outer thread 38 of the cylindrical member 24 cooperates with an inner thread 40 of an adjusting pressure sleeve 42. The adjusting pressure sleeve 42 carries a locking pin 44 which, is slidably received in a locking recess 46 formed in the support sleeve 18, preventing rotation of the adjusting pressure sleeve 42 relative to the support sleeve 18.

The adjustment of the adjusting pressure sleeve 42, which is provided on its bottom with a pressure plate 48, is effected by the adjusting motor 12 and the angle gear 14 via the adjusting shaft 16 as follows. The cooperation of the tooth (sun) gear 34, which is provided at the free end of the adjusting shaft 16, with the tooth (planet) gear 36 which, in turn, cooperates with the longitudinal teeth 30 provided in the central recess 28 of the cylindrical member 24, results in rotation of the cylindrical member 24. The rotation of the cylindrical member 24 leads to its displacement in an adjusting direction due to cooperation of the outer thread 26 with the inner thread 20 of the support sleeve 18.

As a result of the cooperation of the oppositely running outer thread 38, which is provided at a lower portion of the cylindrical member 24, with the inner thread 40 of the adjusting pressure sleeve 42, which is secured against rotation with respect to the support sleeve 18, the adjusting pressure sleeve 48 follows the adjusting displacement of the cylindrical member 24.

Though the present invention was shown and described with references to the preferred embodiment, such is merely illustrative of the present invention and is not to be construed as a limitation thereof and various modifications of the present invention will be apparent to those skilled in the art. It is therefore not intended that the present invention be limited to the disclosed embodiment of details thereof, and the present invention includes all variations and/or alternative embodiments within the spirit and scope of the present invention as defined by the appended claims.

What is claimed is:

1. An auxiliary device for adjusting a rolling mill stand, comprising an adjusting shaft; an adjusting motor for driving the adjusting shaft and supported on a cross-beam of the rolling mill stand; a support sleeve fixedly connected to the cross-beam and having an inner thread; a cylindrical member forming an adjusting spindle and having a first outer thread cooperating with the inner thread of the support sleeve, and a central recess provided with longitudinal teeth; a carrier secured to a bottom of the cross-beam, projecting into the central recess of the adjusting spindle-forming, cylindrical member, and carrying, at an end side thereof, a tooth gear that functions as a planet gear that cooperates with a tooth gear secured at an end of the adjusting shaft, which extends through the carrier, and serves as a sun gear and cooperates with the longitudinal teeth of the central recess of the cylindrical member, the planet and sun gear forming a planetary gear transmission; and an adjusting pressure sleeve connected with the support sleeve for longitudinal displacement relative thereto but without a possibility of rotation relative thereto, wherein the adjusting spindle-forming, cylindrical member has, in a lower portion thereof, a second outer thread running in a direction opposite that of the first thread, the adjusting pressure sleeve having an inner thread corresponding to the second outer thread of the cylindrical member and with which the adjusting pressure sleeve is screwed onto the lower portion of the cylindrical member, so that an adjustment linear displacement of the adjusting spindle-forming, cylinder member is transmitted to the adjusting pressure sleeve.

2. An auxiliary device according to claim 1, wherein the adjusting pressure sleeve is provided, at an end side thereof adjacent to the support sleeve with a locking pin slidably received in a bore formed in the support sleeve for preventing rotation of the adjusting pressure sleeve relative to the support sleeve.

* * * * *